US008000450B2

(12) United States Patent
Andrews

(10) Patent No.: US 8,000,450 B2
(45) Date of Patent: Aug. 16, 2011

(54) APERTURE SHIELD INCORPORATING REFRACTORY MATERIALS

(75) Inventor: Gregory Andrews, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 146 days.

(21) Appl. No.: 11/861,131

(22) Filed: Sep. 25, 2007

(65) Prior Publication Data

US 2009/0080617 A1 Mar. 26, 2009

(51) Int. Cl.
*H01J 35/10* (2006.01)

(52) U.S. Cl. ..... 378/142; 378/141; 378/121

(58) Field of Classification Search ..... 378/119, 378/121, 137, 138, 142
See application file for complete search history.

(56) References Cited

U.S. PATENT DOCUMENTS

| | | | | |
|---|---|---|---|---|
| 6,075,839 | A | 6/2000 | Treseder | |
| 6,115,454 | A | 9/2000 | Andrews et al. | |
| 6,215,852 | B1 | 4/2001 | Rogers et al. | |
| 6,400,799 | B1 * | 6/2002 | Andrews | 378/141 |
| 6,519,317 | B2 | 2/2003 | Richardson et al. | |
| 6,619,318 | B2 | 9/2003 | Dalhart et al. | |
| 7,410,296 | B2 * | 8/2008 | Rogers | 378/203 |
| 2005/0201519 | A1 * | 9/2005 | Bathe et al. | 378/127 |

* cited by examiner

*Primary Examiner* — Courtney Thomas
(74) *Attorney, Agent, or Firm* — Maschoff Gilmore & Israelsen

(57) ABSTRACT

An x-ray tube electron shield is disclosed for interposition between an electron emitter and an anode configured to receive the emitted electrons. The electron shield is configured to withstand the elevated levels of heat produced by electrons backscattered from the anode and incident on the electron shield. This in turn equates to a reduced incidence of failure in the electron shield. In one embodiment the electron shield includes a body that defines a bowl-shaped aperture having a narrowed throat segment. The body of the electron shield includes a first body portion, a second body portion, and a disk portion. These portions cooperate to define the bowl and the throat segment. The throat segment and the lower portion of the bowl are composed of a refractory material and correspond with the regions of the electron shield that are impacted by relatively more backscattered electrons from the anode surface.

30 Claims, 4 Drawing Sheets

APERTURE SHIELD INCORPORATING REFRACTORY MATERIALS

BACKGROUND

1. Technology Field

The present invention generally relates to x-ray generating devices. In particular, the present invention relates to an electron shield, configured to intercept and absorb backscattered electrons, having a construction that prevents heat-related damage thereto.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, and then impinged upon a material of a particular composition. This process typically takes place within an x-ray tube located in the x-ray generating device. The x-ray tube generally comprises a vacuum enclosure, a cathode, and an anode. The cathode, having a filament for emitting electrons, is disposed within the vacuum enclosure, as is the anode that is oriented to receive the electrons emitted by the cathode.

The vacuum enclosure may be composed of metal such as copper, glass, ceramic, or a combination thereof, and is typically disposed within an outer housing. The entire outer housing is typically covered with a shielding layer (composed of, for example, lead or similar x-ray attenuating material) for preventing the escape of x-rays produced within the vacuum enclosure. In addition a cooling medium, such as a dielectric oil or similar coolant, can be disposed in the volume existing between the outer housing and the vacuum enclosure in order to dissipate heat from the surface of the vacuum enclosure. Depending on the configuration, heat can be removed from the coolant by circulating it to an external heat exchanger via a pump and fluid conduits.

In operation, an electric current is supplied to the cathode filament, causing it to emit a stream of electrons by thermionic emission. An electric potential is established between the cathode and anode, which causes the electron stream to gain kinetic energy and accelerate toward a target surface disposed on the anode. Upon impingement at the target surface, some of the resulting kinetic energy in converted to electromagnetic radiation of very high frequency, i.e., x-rays.

The characteristics of the x-rays produced depends in part on the type of material used to form the anode target surface. Target surface materials having high atomic numbers ("Z numbers"), such as tungsten or TZM (an alloy of titanium, zirconium, and molybdenum) are typically employed. The resulting x-rays can be collimated so that they exit the x-ray device through predetermined regions of the vacuum enclosure and outer housing for entry into the x-ray subject, such as a medical patient.

One challenge encountered with the operation of x-ray tubes relates to backscattered electrons, i.e., electrons that rebound from the target surface along unintended paths in the vacuum enclosure. These rebounding, backscattered electrons can impact areas of the x-ray tube where such electron impact is not desired. These impacts can either cause excess and possibly damaging heating in the impacted component or result in the creation of "off-focus" x-rays that cloud the x-ray image obtained by the x-ray tube. Either result is undesired.

To minimize the effects of backscattered electrons, an electron shield is often included in x-ray tubes. Interposed between the electron emitting filament of the cathode and the anode target surface, the electron shield includes an aperture through which primary electrons can pass toward impingement on the target surface but is configured to intercept most of the electrons that subsequently backscatter after impingement. The electron shield absorbs a large number of backscattered electrons, thereby preventing their impingement on less desirable portions of the x-ray tube.

Due to the characteristics of tube design, most backscattered electrons intercepted by the electron shield impact the shield about a narrowed portion of the aperture closest the target surface, commonly referred to as the "throat" of the aperture. This results in a relatively large amount of localized electron shield heating about the aperture throat. Known electron shield designs often prove inadequate in handling such heat without causing damage to the electron shield. Indeed, at relatively high x-ray tube power settings, electron shield cracking or other failure at or near the aperture throat can be an all-too common occurrence.

Failure of the electron shield in the manner described above is detrimental to tube performance. In particular, the electron shield often defines a portion of the vacuum envelope in which critical tube components, such as the cathode and anode, are housed. Upon failure of the electron shield, the vacuum can be compromised and x-ray production negatively affected. The x-ray tube can be rendered useless, and must be replaced, often at significant cost.

In light of the above discussion, a need exists for an electron shield that avoids the challenges just described and that acceptably performs at the relatively high power settings common among today's x-ray tube devices.

BRIEF SUMMARY

The present invention has been developed in response to the above and other needs in the art. Briefly summarized, embodiments of the present invention are directed to an electron shield for use in an x-ray tube and configured for interposition between an electron emitter and an anode configured to receive the emitted electrons. The electron shield is configured to withstand the elevated temperature produced by electrons backscattered from the anode and incident on the electron shield. This in turn equates to a reduced incidence of failure in the electron shield.

In one embodiment the electron shield includes a body that defines a bowl-shaped aperture having a narrowed throat segment. The body of the electron shield includes a first body portion, a second body portion, and a disk portion. These portions cooperate to define the bowl and the throat segment. The throat segment and the lower portion of the bowl are composed of a refractory material and correspond with the regions of the electron shield that are impacted by relatively more backscattered electrons from the anode surface. Thus, the electron shield is able to withstand the thermal stress imposed by the backscattered electrons without failure. Additionally, the refractory material assists in smoothing the energy distribution caused by the impacting electrons. This in turn spreads the electron energy absorbed by the shield over a larger area so as to reduce thermal stress to the shield.

In another embodiment, a method is disclosed for manufacturing the electron shield. The method includes forming a first portion of the electron shield composed of a refractory material by a powder metallurgical process. Then a second portion of the electron shield, composed of a high thermal conductivity material, is joined to the first portion by first melting the material and pouring it into a mold that contains the already-formed first portion. After hardening, the finished electron shield component is removed from the mold and machined as needed, then joined to other shield components to form the complete electron shield.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

FIGS. 1-4B depict various features of embodiments of the present invention, which is generally directed to an electron shield for interposition between an electron emitter and an anode configured to receive the emitted electrons, such as in an x-ray tube. Advantageously, the electron shield disclosed in example embodiments of the present invention is configured to withstand the elevated temperature produced by electrons backscattered from the anode and incident on selected portions of the electron shield. This in turn equates to a reduced incidence of failure in the electron shield and in the vacuum envelope, or evacuated enclosure, that it partially defines in the x-ray tube.

Figure 1:
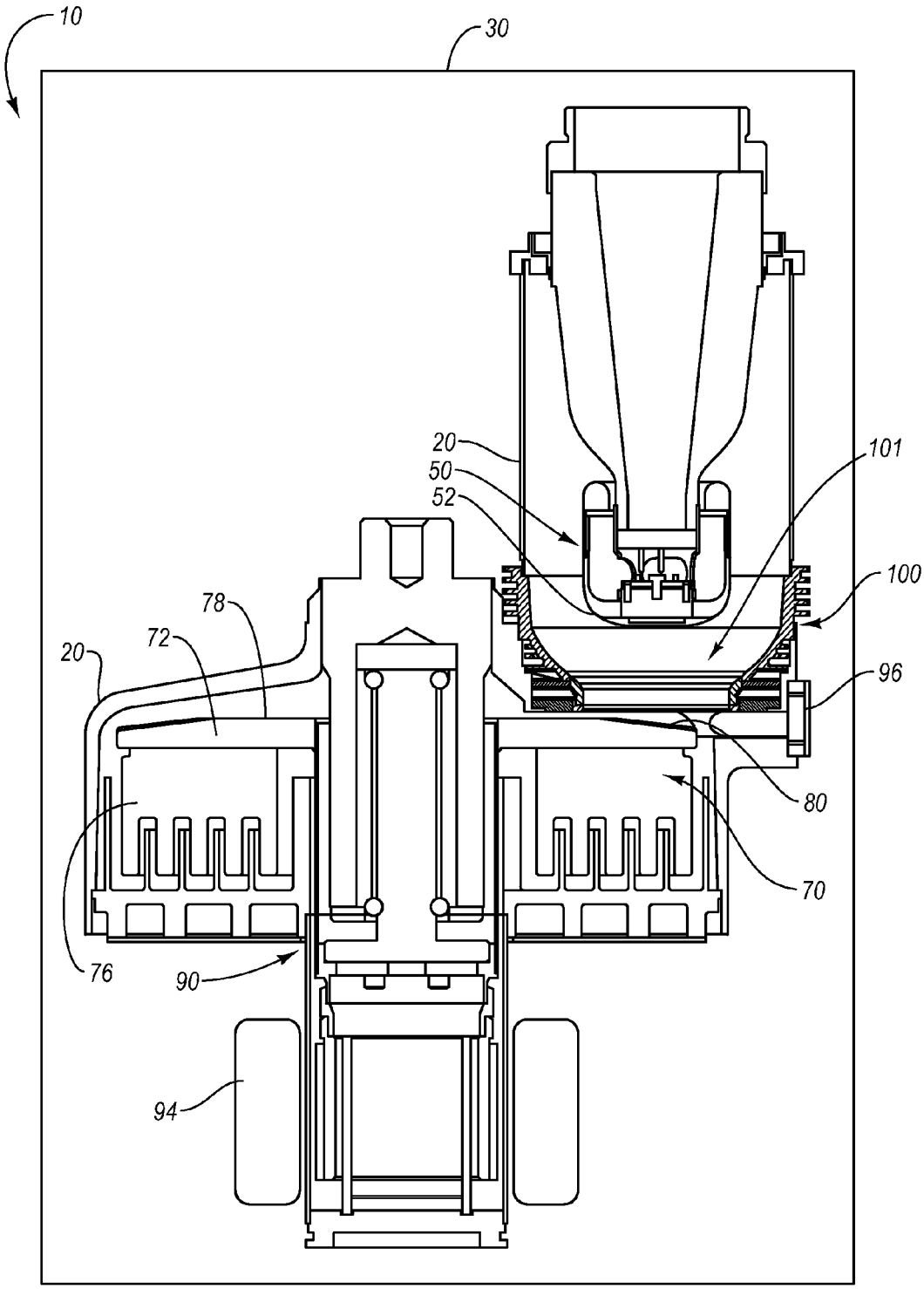
FIG. 1 is a cross sectional view of an x-ray tube that serves as one example environment in which embodiments of the present invention can be practiced.

Reference is first made to FIG. 1, which depicts one possible environment wherein embodiments of the present invention can be practiced. Particularly, FIG. 1 shows an x-ray tube, designated generally at 10, which serves as one example of an x-ray generating device. The x-ray tube 10 generally includes an evacuated enclosure 20, disposed within an outer housing 30, which contains a cathode assembly 50 and an anode assembly 70. The evacuated enclosure 20 defines and provides the necessary vacuum envelope for housing the cathode and anode assemblies 50, 70 and other critical components of the tube 10 while providing the shielding and cooling necessary for proper x-ray tube operation. The evacuated enclosure 20 in one embodiment further includes shielding (not shown) that is positioned so as to prevent unintended x-ray emission from the tube 10 during operation. Note that, in other embodiments, the x-ray shielding is not included with the evacuated enclosure, but rather is joined to the outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. The cathode assembly 50 includes a cathode head 52 that houses an electron source (not shown), such as a filament, for the emission of electrons during tube operation. As such, the electron source is connected to an electrical power source (not shown) to enable the production of relatively high-energy electrons.

Generally responsible for receiving the electrons produced by the electron source and converting them into x-radiation ("x-rays") to be emitted from the evacuated enclosure 20, the anode assembly 70 includes an anode 72 and an anode support assembly 74. The anode 72 includes a substrate 76, preferably composed of TZM, and a target surface 78 disposed thereon. The target surface 78 is composed of Tungsten or a similar alloy. A focal track 80 of the target surface 78 is positioned such that the stream of electrons emitted by the filament impinge on the focal track and produce x-rays for emission from the evacuated enclosure 20 via an x-ray transmissive window 96.

In greater detail, the anode 72 is rotatably supported by the anode support assembly 74, which generally includes a rotor assembly 90 and a stator 94. The stator 94 is circumferentially disposed about a portion of the rotor assembly 90 to provide the needed rotation of the anode 72 during tube operation. Again, it should be appreciated that embodiments of the present invention can be practiced with anode assemblies having configurations that differ from that described herein.

As the production of x-rays described herein is relatively inefficient and yields large quantities of heat, the anode assembly 70 is configured to acceptably remove heat from the anode 72 during tube operation such as, for instance, circulation of a cooling fluid through designated structures of the anode assembly. Notwithstanding the above details, however, the structure and configuration of the anode assembly can vary from what is described herein while still residing within the claims of the present invention.

An electron shield, generally designated at 100, is positioned between the cathode head 52 and the anode 72. The electron shield defines an aperture 101 to allow the electrons emitted from the filament assembly to pass through the shield for impingement on the anode focal track 80. The electron shield 100 is further configured to intercept electrons that rebound, or "backscatter," from the anode target surface 78 during tube operation. Interception of the backscattered electrons by the electron shield 100 prevents the electrons from impacting and possibly damaging other tube components. In accordance with example embodiments of the present invention, the electron shield 100 is configured so as to withstand the relatively extreme thermal stress caused as a result of absorption by the shield of the backscattered electrons, as is described further below.

Figure 2A:
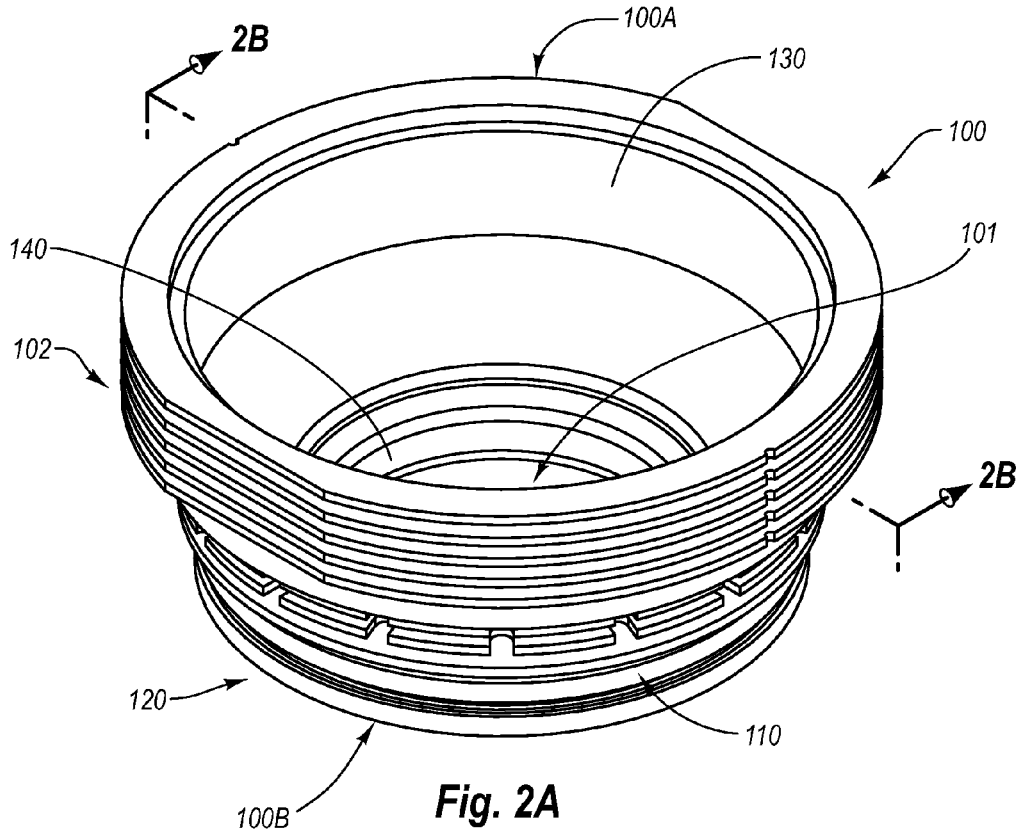
FIG. 2A is a perspective view of an electron shield including a refractory material portion, in accordance with one embodiment of the present invention.
Figure 2B:
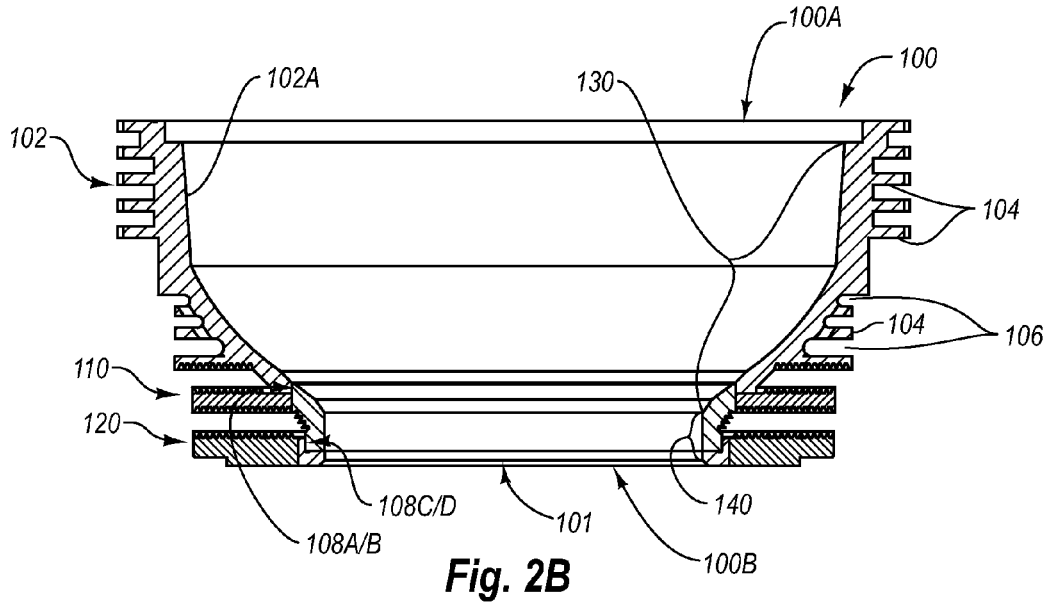
FIG. 2B is a cross sectional view of the electron shield shown in FIG. 2A, taken along the line 2B-2B.

Reference is now made to FIGS. 2A and 2B in describing various details regarding the electron shield 100, according to one example embodiment. As suggested, the electron shield 100 is configured to withstand the extreme temperatures imparted thereto as the result of its absorption of backscattered electrons. Specifically, the electron shield 100 is configured such that the regions of the shield incurring relatively more electron impacts from backscattering are relatively more suited to withstand the resultant thermal stress caused by such impacts.

In detail, FIGS. 2A and 2B show that the electron shield 100 includes a body having a first end 100A and second end 100B, respectively the top and bottom ends, according to the orientation shown in FIG. 2B. As seen in FIG. 1, the first and second ends 100A, 100B are configured to operably mate with corresponding portions of the x-ray tube 10 to define a portion of the evacuated enclosure 20.

As mentioned, the body of the electron shield 100 defines the aperture 101 extending between the first and seconds ends 100A, 100B. As previously discussed, the electron shield 100 is interposed between the electron source of the x-ray tube 10 and the anode 72 such that electrons emitted by the electron source pass through the aperture en route to impingement on the focal track 80 of the anode target surface 78.

As best seen in FIG. 2B, the electron shield 100 is a composite structure, composed of an upper bowl portion 102, a lower bowl portion 110, and a disk portion 120 that are operably joined together to define the shield. Note that though compositely formed of three pieces here, in other embodiments the aperture shield could be formed of more than three pieces, two pieces, or a single piece.

The upper bowl portion 102, a lower bowl portion 110, and the disk portion 120 cooperate to define two regions of the aperture 101, namely, a bowl 130 and a relatively narrow throat 140. Again, it is appreciated that the particular shape of the bowl and throat region of the aperture can be varied from what is explicitly shown and described herein. Each of the three portions that define the electron shield 100 is described in detail below.

The upper bowl portion 102 of the electron shield 100 includes an inner surface 102A that defines a majority portion of the aperture bowl 130. The exterior of the upper bowl portion 102 has defined thereon a plurality of annular cooling fins 104 for the conduction of heat from the electron shield 100. The lower cooling fins 104 cooperate with one another and with adjacent structures of the evacuated enclosure 20, as shown in FIG. 1, to define fluid passageways 106 that annularly surround exterior portions of the upper bowl portion 102. Absorption by the electron shield 100 of the majority of backscattered electrons during tube operation results in large quantities of heat being imparted to the electron shield. The fluid passageways 106 are employed to contain a coolant that can be circulated through the passageways to remove this heat from the electron shield 100. The upper bowl portion 102 is composed of a thermally conductive material, such as oxygen-free high conductivity copper ("OFHC"), which exhibits excellent heat conduction capability. Other thermally conductive materials may also be employed.

An annular mating surface 108A is included on the upper bowl portion 102 and configured to mate with a corresponding surface of the lower bowl portion 110. Joining of the upper bowl portion 102 with the lower bowl portion 110 can be achieved via brazing or other suitable bonding procedure. Again, the upper and lower bowl portions can be defined by a single piece or more than two pieces, if so desired.

Figure 3A:
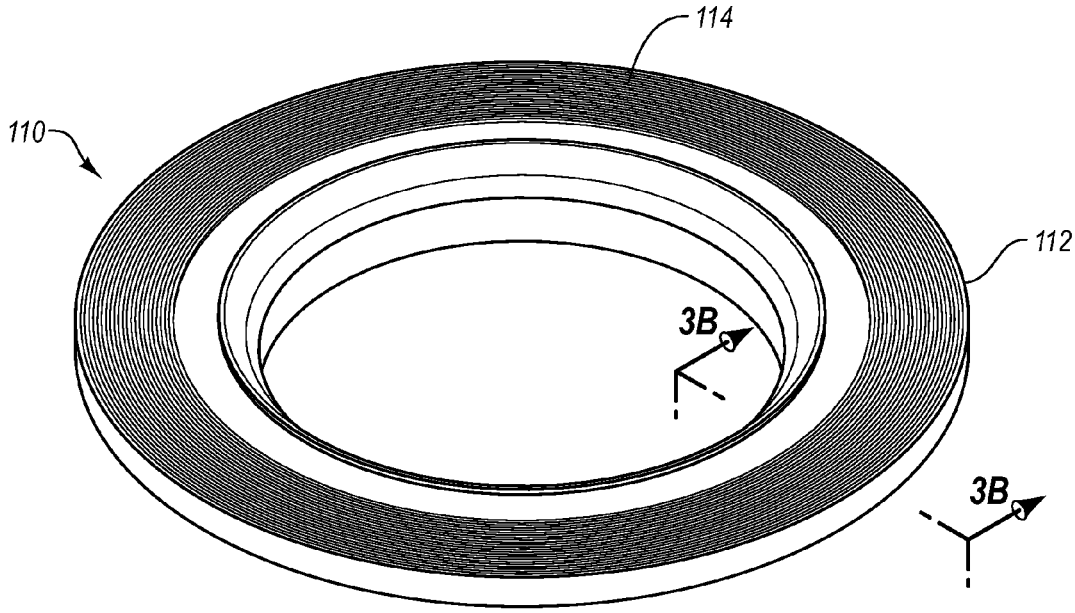
FIG. 3A is a perspective view of a lower bowl portion of the electron shield shown in FIG. 2A.
Figure 3B:
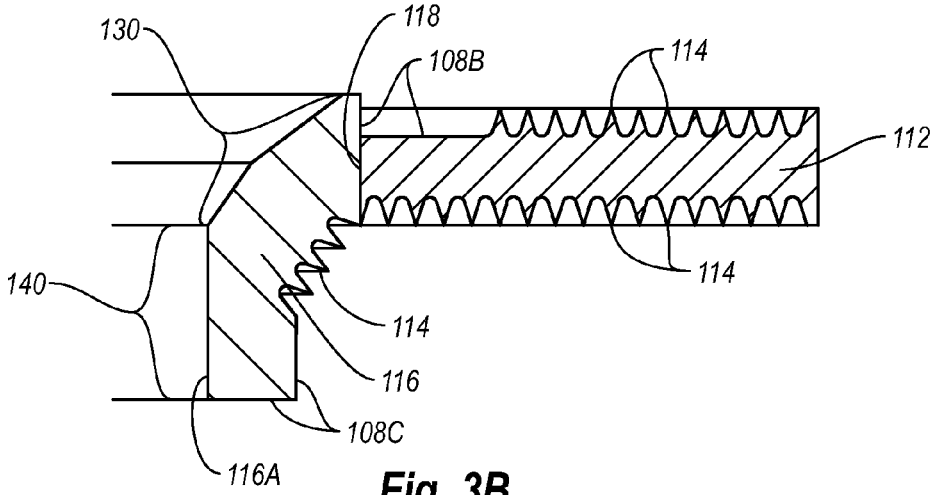
FIG. 3B is a cross sectional view of a portion of the lower bowl portion shown in FIG. 3A, taken along the line 3B-3B.

Together with FIGS. 2A and 2B, reference is now made to FIGS. 3A and 3B in describing in greater detail the lower bowl portion 110. The lower bowl portion 110, including a fin portion 112 and an inner portion 116 that are mated together at an interface 118, joins to the upper bowl portion via an annular mating surface 108B that is shaped so as to correspond with the mating surface 108A of the upper bowl portion 102. The fin portion 112 defines an annular cooling fin similar in function to the cooling fins 104 of the upper bowl portion 102. The fin portion 112 includes a plurality of extended surfaces 114 that serve to increase surface area of the fin portion 112 so as to enhance heat transfer therefrom. In the present embodiment, the fin portion 112 is composed of a thermally conductive material, such as OFHC.

The inner portion 116 of the lower bowl portion 110 includes an annular inner surface 116A that defines portions of both the bowl 130 and the throat 140, as best seen in FIG. 3B. The inner portion 116 also includes an annular mating surface 108C that is shaped to mate with a corresponding mating surface of the electron shield disk portion 120, discussed below. Such mating can be achieved via brazing or other suitable bonding process. Extended surfaces 114 are also included on the inner portion 116 to enhance heat transfer therefrom.

Figure 4A:
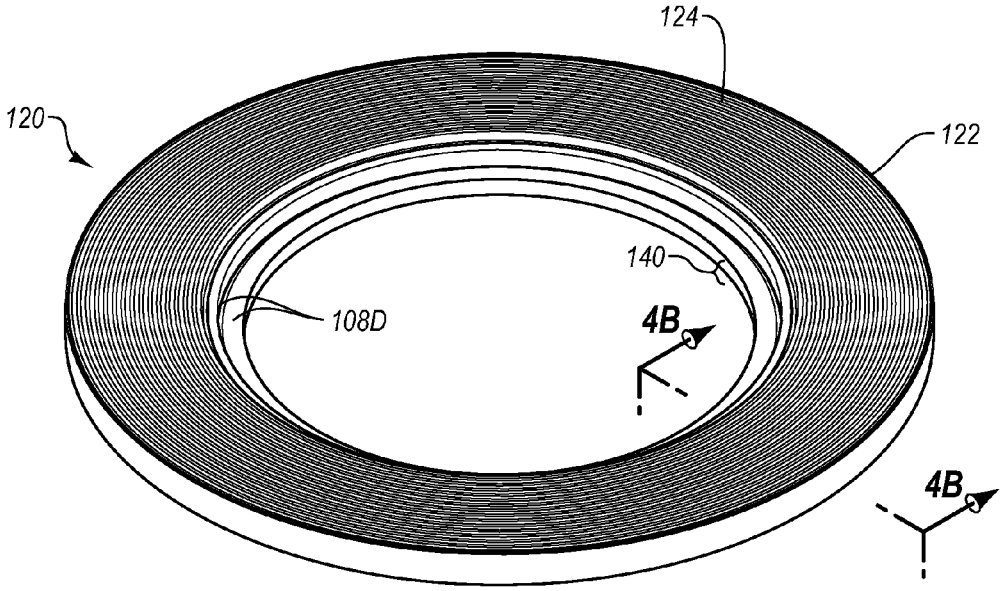
FIG. 4A is a perspective view of a disk portion of the electron shield shown in FIG. 2A.
Figure 4B:
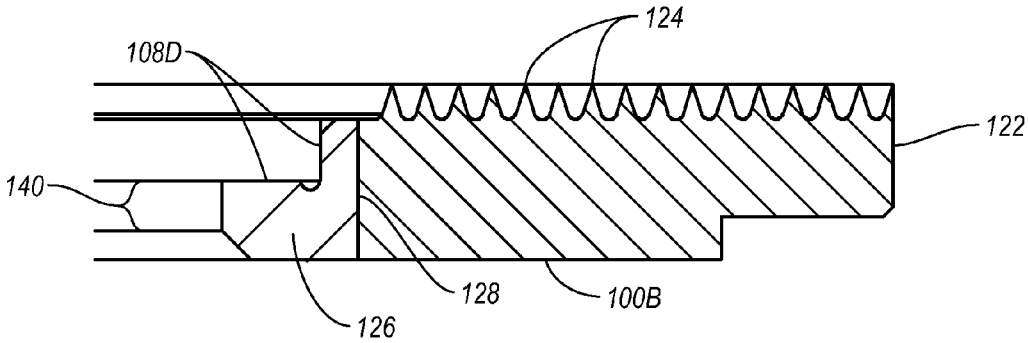
FIG. 4B is a cross sectional view of a portion of the disk portion shown in FIG. 4A, taken along the line 4B-4B.

Together with FIGS. 2A-3B, reference is now made to FIGS. 4A and 4B in describing in greater detail the disk portion 120 of the electron shield 100. The disk portion 120, including an outer portion 122 and an inner portion 126 that are mated together at an interface 128, joins to the lower bowl portion 110 via an annular mating surface 108D that is shaped to so as to correspond with the mating surface 108C of the lower bowl portion. Such mating can be achieved via brazing or other suitable bonding process. The outer portion 122 serves as an additional cooling fin for the electron shield 100, and as such includes a plurality of extended surfaces 124 annularly defined on a top surface of the outer portion to enhance heat transfer from the electron shield. In the present embodiment, the outer portion 122 is composed of a suitable thermally conductive material, such as dispersion strengthened copper alloy including aluminum oxide, such as the type manufactured under the trade name GLIDCOP®.

The inner portion 126 of the disk portion 120 includes an annular inner surface 126A that defines a portion of the throat 140. As already mentioned, the rest of the throat 140 is defined by the lower bowl portion 110 (see FIG. 2B). The disk portion 120 also defines the second end 100B of the electron shield 100.

In accordance with example embodiments of the present invention, the electron shield 100 is configured to improve reliability and performance thereof. In particular, the electron shield 100 is configured so as to withstand the thermal stress the shield is subjected to in absorbing backscattered electrons incident thereon during operation of the x-ray tube 10. In present embodiments, this is achieved by configuring the structure of the electron shield 100 in such a manner as to best withstand the above-referenced thermal stress.

Specifically, the throat 140 and a lower portion of the bowl 130 of the electron shield 100 are configured in the illustrated embodiment to include a material that is configured to withstand thermal stress without failure or structural compromise.

In the present embodiment, the above aims are achieved by forming the portions of the electron shield 100 that define the throat 140 and the bowl 130 with a refractory material, such as molybdenum, tungsten, or niobium, or suitable alloys thereof such as TZM (an alloy composed of tungsten, zirconium, and molybdenum). Specifically, the inner portion 116 of the lower bowl portion 110 and the inner portion 126 of the disk portion 120 are composed in the present embodiment of TZM, which portions define the throat 140 and the lower portion of the bowl 130, as seen in FIG. 2B.

The refractory material TZM is mechanically stable at high operating temperatures, which prevents cracking or failure of the electron shield 100. TZM also exhibits a high yield strength, which enables the electron shield structure to be made relatively thinner while still maintaining suitable shield strength. For instance, GLIDCOP® has a yield strength of about 45 ksi, while standard refractory materials have a yield strength of about 150 ksi. A thinner electron shield structure improves heat conductivity from the electron shield 100 to heat removing components of the x-ray tube, such as cooling fluid circulated about the electron shield. This also mitigates the fact that refractory materials have a lower thermal conductivity compared to OFHC copper or GLIDCOP®.

Note that the inner portions 116 and 126 of the lower bowl portion 110 and the disk portion 120, respectively, are composed of the refractory material as these are the areas of the electron shield 100 that receive relatively more impacts from backscattered electrons during tube operation. As such, these areas are more prone to failure in known electron shield configurations. Also, use of refractory materials in the above-mentioned locations allows the portions of the electron shield 100 that join to other portions of the x-ray tube 10 to define the evacuated enclosure 20, namely, the electron shield first and second ends 100A and 100B (see FIG. 1) to be composed of materials such as GLIDCOP® and OFHC that share similar thermal expansion properties with the tube portions to which they attach. In one embodiment, the adjacent structures to which the electron shield 100 attaches to help define the evacuated enclosure 20 are composed of stainless steel.

It is appreciated that, in addition to refractory materials, other materials may be suited for use in the electron shield throat and lower bowl portions. Preferred characteristics of the material include thermal stability at the high temperatures encountered in the electron shield, relatively high thermal conductivity, acceptable mechanical strength, and a coefficient of thermal expansion that is sufficiently similar to the other materials from which the electron shield is composed—such as OFHC and GLIDCOP® in the present embodiment. Thus, it should be appreciated that composition of the electron shield should not be limited only to what is explicitly described herein.

It is further appreciated that the portion of the electron shield composed of the refractory material can vary according to the need of a particular application. Also, the portion of the electron shield that includes the refractory material can be grouped differently than what is shown in the accompanying drawings. For instance, the refractory portion of the electron shield can be included as one integral piece that is suitably attached to other portions of the electron shield. These and other like modifications to the electron shield are contemplated as part of the present invention.

The lower bowl portion 110 and the disk portion 120 as shown in FIG. 3A-4B are separately formed in one embodiment, as follows. Known powder metallurgy processes are employed to convert a refractory powder and form it into the refractory portion of the respective electron shield component, i.e., the inner portion 116 of the lower bowl portion 110, or the inner portion 126 of the disk portion 120. A suitably shaped mold is used to contain the refractory powder during the process and ensure the proper dimensions for the piece.

Once the refractory portion has been formed, a thermally conductive material, i.e., OFHC in the case of the lower bowl portion 110 and GLIDCOP® in the case of the disk portion 120 according to the present embodiment, is melted and poured in the mold about the formed refractory portion disposed therein. This is commonly known as "back casting," and this defines the interface between the refractory material and the thermally conductive material, i.e., the interface 118 of the lower bowl portion 110 and interface 128 of the disk portion 120. Note that the interfaces 118 and 128 can include surface features (not shown) that are inherently formed as a result of the powder metallurgical process. These surfaces increase the surface area of the interface and therefore enhance adhesion between the refractory material and the thermally conductive material. Again, the mold ensures that each piece is formed with the proper shape.

Once hardened, the piece can be removed from its mold, and machining or other honing processes are performed to bring the part within proper tolerances. As mentioned, this process is followed to define both the lower bowl portion 110 and the disk portion 120 having the inner portions 116 and 120, respectively, which are composed of a refractory material. It is appreciated that other processes may be followed to define these portions of the electron shield.

Once they are formed and finished, the lower bowl portion 110 and disk portion 120 are joined together via brazing or other suitable process at the mating surfaces 108C and 108D (FIG. 2B). The separately formed upper bowl portion 102 can then be joined to the lower bowl portion 110 at the mating surfaces 108A and 108B to form the complete electron shield 100. Again, it is appreciated that the electron shield can be composed or more or fewer pieces than the three-piece design depicted in the accompanying drawings, including forming it as one integral piece.

The aperture shield 100 as described above improves the smoothing of the energy distribution caused by the backscattered electrons that impact on the shield. This is so because refractory materials possess relatively high atomic numbers. As such, electrons that impinge a portion of the electron shield composed of a refractory material on average have a higher number of rebounds and re-impacts with the shield before being absorbed thereby. Multiple rebounds of the electron distributes the heat generated by the electron across a relatively larger area of the shield than if the backscattered electron only rebounded once, as is common when impacting less dense portions of known aperture shields. Thus, shield heating is relatively more distributed, which assists in avoiding uneven thermal stress within the shield.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. In an x-ray tube having a cathode and an anode, an electron shield configured to intercept backscattered electrons from the anode, the electron shield comprising:

a body defining an aperture, wherein at least a portion of the body that defines the aperture is composed of a refractory material, the aperture defining an electron collection surface that faces the cathode.

2. The electron shield as defined in claim 1, wherein the aperture defined by the body includes a bowl segment and a throat segment.

3. The electron shield as defined in claim 2, wherein the throat segment is composed of the refractory material.

4. The electron shield as defined in claim 2, wherein at least a portion of the bowl segment is composed of the refractory material, the portion being continuous with the throat segment composed of the refractory material.

5. The electron shield as defined in claim 1, wherein at least a portion of an outer surface of the electron shield is configured to radiate heat directly to a cooling fluid.

6. The electron shield as defined in claim 1, wherein the electron shield body is composed of a plurality of body portions that are joined to one another to define the aperture.

7. The electron shield as defined in claim 1, wherein the refractory material is included in the portion of the body defining the aperture that is impacted by a majority number of electrons.

8. The electron shield as defined in claim 1, wherein the refractory material causes the electron shield to exhibit a smooth energy distribution caused by impacting backscattered electrons.

9. An x-ray tube, comprising:

an evacuated enclosure;

a cathode disposed within the evacuated enclosure and including an emitter that emits a stream of electrons;

an anode disposed within the evacuated enclosure and positioned with respect to the cathode to receive the stream of electrons emitted by the emitter; and an electron shield interposed between the cathode and anode, at least a portion of the electron shield configured to radiate heat directly to a coolant, the electron shield defining an aperture and including:

at least one body portion defining a bowl segment of the aperture; and at least one body portion defining a throat segment of the aperture;

wherein at least one of the body portions includes a portion composed of a refractory material that defines at least a portion of the bowl segment or throat segment.

10. The x-ray tube as defined in claim 9, wherein the entirety of the throat segment of the electron shield is composed of the refractory material, and wherein a portion of the bowl segment adjacent the throat segment is composed of the refractory material.

11. The x-ray tube as defined in claim 9, wherein portions of the electron shield body portions not composed of the refractory material are composed of a thermally conductive material.

12. The x-ray tube as defined in claim 11, wherein the electron shield cooperates to define a portion of the evacuated enclosure and wherein the thermally conductive material has a coefficient of thermal expansion that enables the electron shield body portions composed of the thermally conductive material to mate with adjacent portions of the evacuated enclosure.

13. The x-ray tube as defined in claim 11, wherein the electron shield further comprises a plurality of cooling fins composed of the thermally conductive material, at least some of the cooling fins configured to radiate heat to a cooling fluid.

14. The x-ray tube as defined in claim 9, wherein the refractory material contributes to defining the evacuated enclosure.

15. An electron shield assembly for use in intercepting backscattered electrons from a target surface of an anode, the electron shield assembly comprising:

a body defining an aperture, the aperture having a bowl segment and a throat segment, the body including:

a first body portion defining a first part of the bowl segment;

a second body portion attached to the first body portion, the second body portion defining a second part of the bowl segment and a first part of the throat segment, a portion of the second body portion that defines the bowl segment and the throat segment being composed of a refractory material; and a disk portion attached to the second body portion, the disk portion defining a second part of the throat segment, a portion of the disk portion defining the throat segment being composed of the refractory material.

16. The electron shield assembly as defined in claim 15, wherein:

the second body portion includes at least one annular fin and an inner portion composed of the refractory material; and the disk portion includes an outer portion including at least one annular fin and an inner portion composed of the refractory material.

17. The electron shield assembly as defined in claim 16, wherein first body portion, the second body portion, and the disk portion are brazed to one another.

18. The electron shield assembly as defined in claim 17, wherein a portion of the second body portion that is not composed of the refractory material is composed at least partially of oxygen-free high conductivity copper.

19. The electron shield assembly as defined in claim 18, wherein a portion of the disk portion that is not composed of the refractory material is composed of a dispersion strengthened copper alloy.

20. The electron shield assembly as defined in claim 19, wherein the dispersion strengthened copper alloy is included in a material manufactured under the trade name GLIDCOP.

21. The electron shield assembly as defined in claim 20, wherein the refractory material is an alloy composed of tungsten, zirconium, and molybdenum.

22. The electron shield assembly as defined in claim 21, wherein the first body portion and the disk portion are configured to attach to a portion of an evacuated enclosure that contains the anode.

23. The electron shield assembly as defined in claim 15, wherein the second body portion and the disk portion are integrally formed.

24. The electron shield assembly as defined in claim 22, wherein the first body portion is integrally formed with the second body portion and the disk portion.

25. A method for manufacturing an electron shield having an aperture, the method comprising:

forming a first portion of the electron shield composed of a refractory material, the first portion defining a portion of the aperture; and joining a second portion of the electron shield composed of a high thermal conductivity material to the first portion.

26. The method for manufacturing as defined in claim 25, wherein forming the first portion further comprises:

forming the first portion of the electron shield by a powder metallurgical process.

27. The method for manufacturing as defined in claim 25, wherein joining the second portion further comprises:

melting the high thermal conductivity material; and pouring the melted the high thermal conductivity material into a mold containing the first portion of the electron shield.

28. The method for manufacturing as defined in claim 25, wherein the first and second portions define a segment of the electron shield, the electron shield cooperating to define an evacuated enclosure of an x-ray tube.

29. The method for manufacturing as defined in claim 28, wherein the first portion is radially inward of the second portion of the electron shield.

30. The method for manufacturing as defined in claim 25, wherein the aperture of the electron shield includes a bowl and a throat, and wherein the first portion defines a portion of the throat.

* * * * *